US006411037B1

(12) United States Patent
Ohkawai et al.

(10) Patent No.: US 6,411,037 B1
(45) Date of Patent: Jun. 25, 2002

(54) ARC TUBE FOR DISCHARGE LAMP DEVICE AND METHOD OF MANUFACTURING THE SAME

(75) Inventors: Nobuo Ohkawai; Yoshitaka Ohshima; Takeshi Fukuyo; Shinichi Irisawa, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 182 days.

(21) Appl. No.: 09/612,907

(22) Filed: Jul. 10, 2000

(30) Foreign Application Priority Data

Jul. 12, 1999 (JP) ..... 11-197000

(51) Int. Cl.[7] ..... H01J 17/18
(52) U.S. Cl. ..... 313/623; 313/626
(58) Field of Search ..... 313/623, 624, 313/625, 626

(56) References Cited

U.S. PATENT DOCUMENTS 4,322,248 A * 3/1982 Patrician et al. ..... 313/623
5,877,590 A 3/1999 Fukuyo et al. ..... 313/623
5,962,976 A 10/1999 Irisawa et al. ..... 313/623

FOREIGN PATENT DOCUMENTS

JP 10-27574 1/1998 ..... H01J/61/36

* cited by examiner

*Primary Examiner*—Vip Patel
(74) *Attorney, Agent, or Firm*—Sughrue Mion, PLLC

(57) ABSTRACT

A method of manufacturing an arc tube for a discharge lamp device.

The method comprises:

inserting a first electrode assembly having an electrode, a molybdenum foil and a molybdenum lead wire connected integrally in series from a first open end of a glass pipe for the arc tube having a swollen chamber portion formed in a middle part in a longitudinal direction such that a tip of the electrode of the first electrode assembly is protruded into the chamber portion;

introducing an antioxidant gas from a second open end of the glass pipe into the glass pipe;

inserting the first open end of the glass pipe into a gas chamber to which the antioxidant gas is to be supplied; and pinch-sealing a first region including the molybdenum foil of the first electrode assembly in the glass pipe for a primary pinch seal with holding the first open end of the glass pipe in an antioxidant gas atmosphere.

12 Claims, 5 Drawing Sheets

W
W1
W2
W3
A
A'
P
Xe
LN2
22
24
24a
24b
26a
26b
26c
40
42
44
50
52
54
6
7
8
8a
8(8b)
8b1

ARC TUBE FOR DISCHARGE LAMP DEVICE AND METHOD OF MANUFACTURING THE SAME

BACKGROUND OF THE INVENTION

1. Field of the Invention

The present invention relates to an arc tube for a discharge lamp device in which a region including at least a molybdenum foil of an electrode assembly having an electrode, the molybdenum foil and a molybdenum lead wire connected integrally in series is sealed and fixed to a primary pinch seal portion and a secondary pinch seal portion on both ends respectively and the electrodes are opposed to each other in a central sealed chamber portion filled with a luminescent substance, and to a method of manufacturing the arc tube for a discharge lamp device.

2. Description of the Related Art

FIG. 7 shows a conventional discharge lamp device having such a structure that a front end portion of an arc tube is supported by one lead support 3 protruded forward from an insulating base 2, a rear end of the arc tube 5 is supported in a concave portion 2*a* of the base 2, and a portion of the arc tube 5 provided close to the rear end thereof is held by a metal support member S fixed to a front surface of the insulating base 2. A front end side lead wire 8*b* led from the arc tube 5 is fixed to the lead support 3 through welding, while a rear end side lead wire 8*a* penetrates through a bottom wall 2*b* formed in the concave portion 2*a* of the base 2 and is fixed through welding to a terminal 9 provided on the bottom wall 2*b*. The symbol G denotes a cylindrical ultraviolet radiation shielding glove which serves to cut a ultraviolet component having such a wavelength area as to be harmful to a human body in light emitted from the arc tube 5 and is integrally welded to the arc tube 5.

The arc tube 5 has such a structure that electrodes 6 are provided opposite to each other between a longitudinal pair of pinch seal portions 5*b* and a sealed chamber portion 5*a* filled with a luminescent substance is formed. A molybdenum foil 7 for connecting the tungsten electrodes 6 protruded into the sealed chamber portion 5*a* and molybdenum lead wires 8*a* and 8*b* led from the pinch seal portions 5*b* is sealed and fixed into the pinch seal portions 5*b*. Thus, airtightness can be maintained in the pinch seal portions 5*b* and 5*b*.

More specifically, it is desirable that the electrode 6 should be formed of tungsten having a high durability. However, the tungsten has a very different coefficient of linear expansion from that of glass, is less stuck to the glass and has a poor airtightness. Accordingly, when the molybdenum foil 7 having a coefficient of thermal expansion approximating to that of the glass and stuck comparatively well to the glass is connected to the tungsten electrode 6 and is then sealed at the pinch seal portion 5*b*, the airtightness of the pinch seal portion 5*b* can be maintained.

As a method of manufacturing the arc tube 5, first of all, an electrode assembly A having the electrode 6, the molybdenum foil 7 and the lead wire 8 connected integrally is inserted from one of open end sides of a cylindrical glass pipe W having a spherical swollen portion $w_2$ formed in the middle of a linear extended portion $w_1$ and a position $q_1$ in the vicinity of the spherical swollen portion $w_2$ is subjected to primary pinch seal as shown in FIG. 8A. As shown in FIG. 8B, then, a luminescent substance P is put into the spherical swollen portion $w_2$ from the other open end side. As shown in FIG. 8C, subsequently, another electrode assembly A is inserted and a position $q_2$ in the vicinity of the spherical swollen portion $w_2$ is heated and is subjected to secondary pinch seal while the spherical swollen portion $w_2$ is cooled with liquid nitrogen such that the luminescent substance is not vaporized. Thus, the spherical swollen portion $w_2$ is sealed. Consequently, the arc tube 5 having a chipless sealed chamber portion 5*a* is completed. At the primary pinch-sealing step shown in FIG. 8A, an antioxidant gas (generally, an inert gas or a reducing gas) is supplied into the glass pipe W to carry out the pinch seal such that the electrode assembly A is not oxidized. At the secondary pinch-sealing step shown in FIG. 8(*c*), the open end is sealed as indicated by the reference numeral $q_3$. Consequently, a discharge starting gas introduced into the glass pipe W is filled in the glass pipe W and the spherical swollen portion $w_2$ is cooled with the liquid nitrogen such that the discharge starting gas and the luminescent substance are not vaporized. Thus, the glass pipe W is almost evacuated to carry out the pinch seal.

In the conventional method of manufacturing an arc tube, however, the vicinity of a boundary between the molybdenum lead wire 8*a* led from the primary pinch seal portion (the pinch seal portion on the rear end side) and the pinch seal portion particularly becomes fragile so that a mechanical strength thereof is reduced. Consequently, a disconnection is easily caused.

The present inventor has investigated the cause of the drawback. Although the antioxidant gas is introduced into the glass pipe W in order to prevent the electrode assemblies A from being oxidized during the primary pinch seal, it is not led to the open end side of the linear extended portion $w_1$ in a lower portion immediately after the next pinch seal. Consequently, it has been confirmed that the molybdenum lead wire 8 set in a high temperature state is oxidized in contact with oxygen in the air or a part of a molybdenum structure is evaporated or recrystallized due to a high temperature and is therefore made fragile.

JP-A-10-27574 has disclosed a structure in which pinch seal is carried out by supplying an antioxidant gas from a gas supply nozzle having a smaller diameter toward an open end on an electrode assembly A insertion side of a glass pipe at a primary pinch-sealing step. With such a structure, however, the antioxidant gas supplied from the gas supply nozzle partially hits against the lead wire 8 but the whole lead wire 8 cannot be covered. Therefore, it is impossible to effectively prevent the lead wire from becoming fragile.

SUMMARY OF THE INVENTION

In consideration of the drawbacks of the related art, it is an object of the present invention to provide an arc tube for a discharge lamp device in which a mechanical strength of a molybdenum lead wire in a primary pinch seal portion is not reduced, and a method of manufacturing the arc tube for a discharge lamp device.

In order to achieve the above-mentioned object, a first aspect of the present invention is directed to an arc tube for a discharge lamp device in which a region including at least a molybdenum foil of a pair of electrode assemblies having an electrode, the molybdenum foil and a molybdenum lead wire connected integrally in series is sealed and fixed to a primary pinch seal portion and a secondary pinch seal portion on both ends, and the electrodes are provided opposite to each other in a central sealed chamber portion filled with a luminescent substance and the lead wire is led from the pinch seal portions on the both ends, wherein, in the primary pinch seal portion, an electrode assembly insertion region of a glass pipe for the arc tube is pinch-sealed with the whole electrode assembly inserted into the glass pipe held in an antioxidant gas atmosphere so that the lead wire has a tensile strength of 10000 kgf/cm$^2$ or more.

If the tensile strength of the lead wire is less than 10000 kgf/cm$^2$, an environment-proof property against vibrations, impacts and an external change in a temperature and a lifetime characteristic against a change in a temperature caused by turning on and off are affected. Therefore, it is desirable that a tensile strength of 10000 kgf/cm$^2$ or more should be maintained.

The lead wire on the primary pinch seal portion side is held in the antioxidant gas atmosphere having no oxygen during the primary pinch seal. Therefore, the oxidation can be prevented and cooling is also carried out with the antioxidant gas at the primary pinch-sealing step. Consequently, it is possible to prevent a molybdenum structure from being evaporated and recrystallized. More specifically, the lead wire can be prevented from being fragile so that the original mechanical strength of the molybdenum lead wire, that is, a tensile strength of 10000 kgf/cm$^2$ or more can be maintained, thereby obtaining a high durability.

A second aspect of the present invention is directed to the arc tube for a discharge lamp device according to the first aspect of the present invention, wherein the primary pinch seal portion is formed by inserting and providing the electrode assembly such that a tip of the electrode is protruded from an open end of the glass pipe into a chamber portion, provisionally pinch-sealing a side of the molybdenum foil to which the lead wire is to be connected, then holding the inside of the glass pipe in a vacuum state, and regularly pinch-sealing a portion of a region to be primarily pinch-sealed which has not been pinch-sealed.

During the regular pinch seal in the primary pinch seal, a negative pressure in the glass pipe, as well as the press force of a pincher, acts on the heated and softened glass layer, and the glass layer is welded to the surface of the molybdenum foil by pressure and is fixed in contact without a clearance.

Moreover, the lead wire is held in the antioxidant gas atmosphere during the regular pinch seal after the provisional pinch seal as well as the provisional pinch seal at the primary pinch-sealing step. Consequently, the lead wire is not oxidized at the primary pinch-sealing step, and furthermore, is cooled with the antioxidant gas. Therefore, the molybdenum structure can be prevented from being evaporated and recrystallized so that the original mechanical strength of the lead wire can be maintained, thereby obtaining a high durability.

A third aspect of the present invention is directed to the arc tube for a discharge lamp device according to the first or second aspect of the present invention, wherein the secondary pinch seal portion is formed by inserting and providing the electrode assembly such that the tip of the electrode is protruded from the open end of the glass pipe into the chamber portion, removing air in the glass pipe and cooling and liquefying a discharge starting gas filled in the pipe, thereby holding the glass pipe in a vacuum state, and pinch-sealing a region including the molybdenum foil in the glass pipe.

The lead wire on the secondary pinch seal portion side is pinch-sealed in an almost vacuum state in the discharge starting gas atmosphere having no oxygen. At the secondary pinch-sealing step, therefore, the oxidation can be prevented. Moreover, the glass pipe is set in the almost vacuum state. Consequently, the heat of the glass pipe which is heated to have a high temperature is transferred to the electrode assembly (lead wire) with difficulty. In addition, the chamber portion is cooled in order to cool and liquefy the discharge starting gas. Correspondingly, a period for which the lead wire is maintained to have the high temperature can be shortened at the secondary pinch-sealing step and the molybdenum structure can be prevented from being evaporated and recrystallized. Consequently, the original mechanical strength of the lead wire can be maintained and a high durability can be obtained.

Moreover, the molybdenum foil in the secondary pinch seal portion is pinch-sealed in the almost vacuum state. Therefore, a negative pressure in the glass pipe, as well as the press force of the pincher, acts on the heated and softened glass layer during the pinch seal, and the glass layer is welded to the surface of the molybdenum foil by pressure and is fixed in contact without a clearance.

A fourth aspect of the present invention is directed to a method of manufacturing an arc tube for a discharge lamp device comprising a primary pinch-sealing step of inserting an electrode assembly having an electrode, a molybdenum foil and a molybdenum lead wire connected integrally in series from one of open ends of a glass pipe for the arc tube having a swollen chamber portion formed on a middle part in a longitudinal direction such that a tip of the electrode is protruded into the chamber portion, introducing an antioxidant gas from the other open end of the glass pipe into the glass pipe, and pinch-sealing a region including the molybdenum foil in the glass pipe, wherein the primary pinch seal is carried out by inserting an open end of the glass pipe on an electrode assembly insertion side into a gas chamber to which the antioxidant gas is to be supplied and holding the open end of the glass pipe in an antioxidant gas atmosphere.

The antioxidant gas is introduced from the open end of the glass pipe on the electrode assembly non-insertion side into the glass pipe in which the electrode assembly is inserted, and the open end of the glass pipe on the electrode assembly insertion side is exposed to the antioxidant gas in the gas chamber. Consequently, even if the pinch seal portion is maintained to have the high temperature after the primary pinch-sealing step as well as during the primary pinch-sealing step, the molybdenum lead wire is held in the antioxidant gas atmosphere to prevent oxidation and comes in contact with the antioxidant gas to radiate heat so that the molybdenum structure can be prevented from being evaporated and recrystallized. Moreover, the lead wire can be prevented from becoming fragile. Thus, the original mechanical strength of the molybdenum lead wire can be maintained.

A fifth aspect of the present invention is directed to the method of manufacturing an arc tube for a discharge lamp device according to the fourth aspect of the present invention, wherein, in the primary pinch-sealing portion, a side of the molybdenum foil to which the lead wire is to be connected is provisionally pinch-sealed, the glass pipe is then held in a vacuum state, and a portion of a region to be primarily pinch-sealed which has not been pinch-sealed is regularly pinch-sealed.

During the regular pinch seal in the primary pinch seal, a negative pressure in the glass pipe, as well as the press force of a pincher, acts on the heated and softened glass layer, and the glass layer is welded to the surface of the molybdenum foil by pressure and is fixed in contact without a clearance.

Moreover, the lead wire is held in the antioxidant gas atmosphere during the regular pinch seal after the provisional pinch seal as well as during the provisional pinch seal at the primary pinch-sealing step. Consequently, the lead wire can be prevented from being oxidized and the molybdenum structure can be prevented from being evaporated and recrystallized at the primary pinch-sealing step. Therefore, the original mechanical strength of the lead wire can be maintained, thereby obtaining a high durability.

A sixth aspect of the present invention is directed to the method of manufacturing an arc tube for a discharge lamp device according to the fourth or fifth aspect of the present invention, wherein the gas chamber is constituted by an inert gas supply port having a greater size than a bore of the open end of the glass pipe, and is pinch-sealed with the open end of the glass pipe for the arc tube inserted in the antioxidant gas supply port by a predetermined depth such that the open end of the glass pipe for the arc tube does not come in contact with air.

At the primary pinch-sealing step, the open end of the glass pipe is reliably covered with the antioxidant gas supplied from the antioxidant gas supply port so that the molybdenum lead wire extended from the open end of the glass pipe cannot come in contact with the air. Consequently, the molybdenum lead wire can be prevented from being oxidized. Moreover, the flow of the antioxidant gas is generated. Thus, the heat radiating function of the lead wire can be enhanced so that the molybdenum structure can be reliably prevented from being evaporated and recrystallized.

A seventh aspect of the present invention is directed to the method of manufacturing an arc tube for a discharge lamp device according to any of the fourth to sixth aspects of the present invention, further comprising, after the primary pinch-sealing step, a filling substance supply step of supplying a filling substance such as a luminescent substance from the other open end of the glass pipe to the chamber portion and a secondary pinch-sealing step of inserting the electrode assembly having the electrode, the molybdenum foil and the molybdenum lead wire connected integrally in series from the other open end of the glass pipe such that the tip of the electrode is protruded into the chamber portion and pinch-sealing a region including the molybdenum foil of the glass pipe, wherein air in the glass pipe is removed and a discharge starting gas is filled in the glass pipe prior to the secondary pinch-sealing step, and the discharge starting gas is cooled and liquefied to hold the glass pipe in a vacuum state, thereby carrying out the second pinch-sealing step.

The lead wire on the secondary pinch seal portion side is pinch-sealed in the almost vacuum state in the discharge starting gas atmosphere having no oxygen. Therefore, the oxidation can be prevented at the secondary pinch-sealing step. During the secondary pinch seal, moreover, the glass pipe is set in the almost vacuum state. Therefore, the heat of the glass pipe which is heated to have a high temperature is transferred to the electrode assembly (lead wire) with difficulty. In addition, the chamber portion is cooled in order to cool and liquefy the discharge starting gas. Correspondingly, a period for which the lead wire is maintained to have a high temperature can be shortened at the secondary pinch-sealing step. Consequently, the molybdenum structure can be prevented from being evaporated and recrystallized. More specifically, the lead wire can be prevented from becoming fragile so that the original mechanical strength of the lead wire can be maintained.

Moreover, the molybdenum foil in the secondary pinch seal portion is pinch-sealed in the almost vacuum state. During the pinch seal, therefore, a negative pressure in the glass pipe, as well as the press force of the pincher, acts on the heated and softened glass layer. Consequently, the glass layer is welded to the surface of the molybdenum foil by pressure and is fixed in contact without a clearance.

BRIEF DESCRIPTION OF THE DRAWINGS

FIG. 3A is an enlarged sectional view showing a provisional pinch-sealing step, and FIG. 3B is an enlarged sectional view showing a regular pinch-sealing step;

FIG. 4A is a view illustrating a provisional pinch-sealing step at a primary pinch-sealing step, FIG. 4B is a view illustrating a regular pinch-sealing step at the primary pinch-sealing step, FIG. 4C is a view illustrating a step of putting a luminescent substance, FIG. 4D is a view illustrating a step of sealing the luminescent substance, and FIG. 4E is a view illustrating a secondary pinch-sealing step;

DETAILED DESCRIPTION OF THE PREFERRED EMBODIMENTS

A preferred embodiment of the present invention will be described below with reference to embodiments.

FIGS. 1 to 4E show an embodiment of the present invention.

Figure 7:
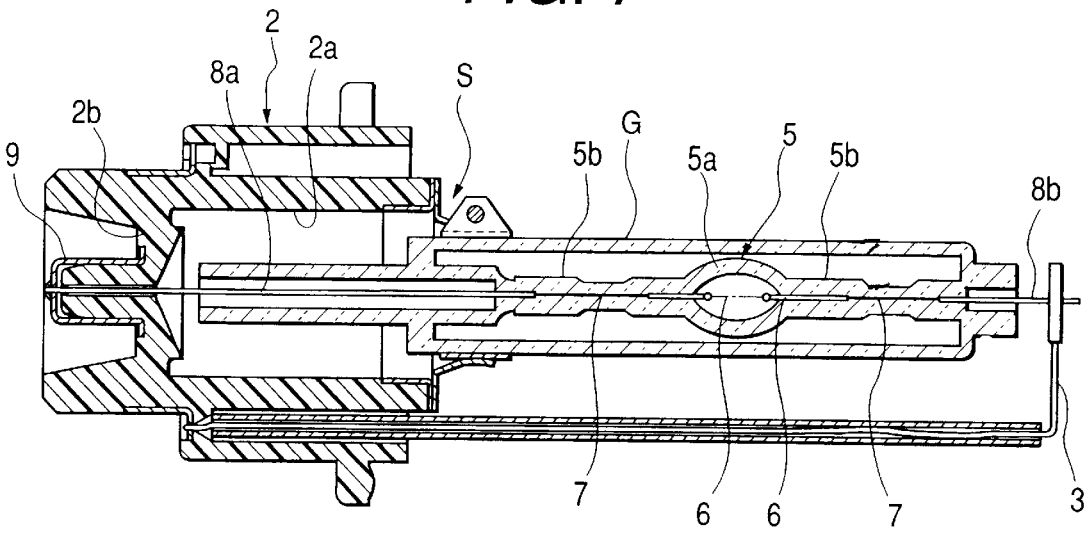
FIG. 7 is a sectional view showing a conventional discharge lamp.
Figure 8A:
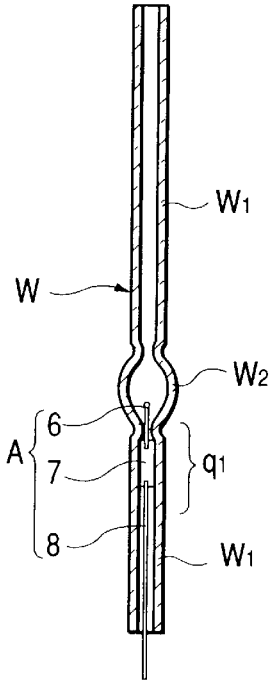
FIG. 8A PRIOR ART
FIG. 8 is a view illustrating a conventional process for manufacturing an arc tube.
Figure 8B:
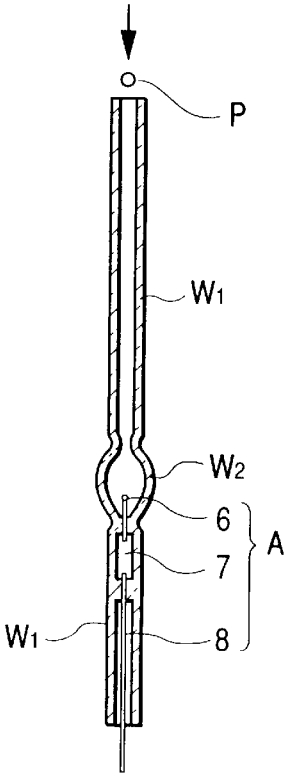
FIG. 8B PRIOR ART
Figure 8C:
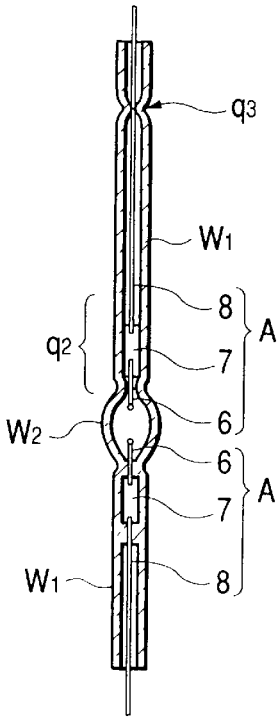
FIG. 8C PRIOR ART

In these drawings, the discharge lamp device to which an arch tube 10 is to be attached is the same as that of the conventional structure shown in FIG. 7 and description thereof will be omitted.

The arc tube 10 has such a structure that a portion provided close to a spherical swollen portion $w_2$ of a circular pipe-shaped quartz glass pipe W having the spherical swollen portion $w_2$ formed in the middle of a linear extended portion $w_1$ in a longitudinal direction is pinch-sealed and pinch seal portions 13 having rectangular cross sections are formed on both ends of an elliptical chipless sealed chamber portion 12 forming a discharge space. The sealed chamber 12 is filled with a discharge starting gas, mercury and a metal halide (which will be hereinafter referred to as a luminescent substance).

Tungsten electrodes 6 and 6 forming discharge electrodes are provided opposite to each other in the sealed chamber portion 12. The electrodes 6 and 6 are connected to a molybdenum foil 7 sealed with the pinch seal portions 13 and 13. Molybdenum lead wires 8 (a lead wire at the rear end side is indicated as 8*a* and a lead wire at the front end side is indicated as 8*b*) connected to the molybdenum foils 7 are led from the ends of the pinch seal portions 13 (a pinch seal portion at the rear end side is indicated as 13A and a pinch seal portion at the front end side is indicates as 13B). The lead wire 8*a* led from the pinch seal portion 13A at the rear end side is inserted through a circular pipe shaped portion 14 to be a non-pinch seal portion and is extended toward the outside.

Figure 1:
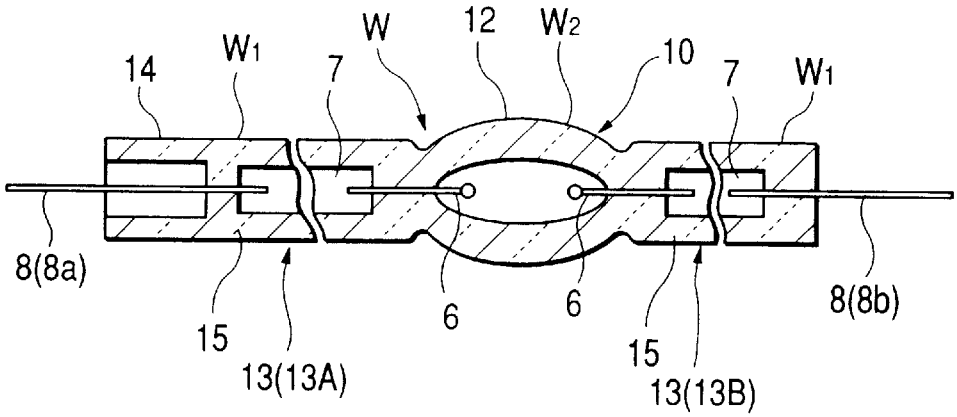
FIG. 1 is a longitudinal sectional view showing an arc tube for a discharge lamp device according to an embodiment of the present invention.

The structure of the appearance of the arc tube 10 shown in FIG. 1 is not different from the conventional arc tube 5 shown in FIG. 7 at first sight. However, firstly, the molybdenum lead wire (the lead wire on the primary pinch seal portion side) 8*a* at the rear end side maintains a mechanical strength which approximates to the original mechanical strength of the lead wire without oxidation at a pinch-sealing step.

Secondly, glass layers 15 of the pinch seal portions 13A and 13B are firmly provided in close contact with the molybdenum foils 7 and the electrodes 6, respectively.

Figures 4A, 4B, 4C, 4D, 4E:
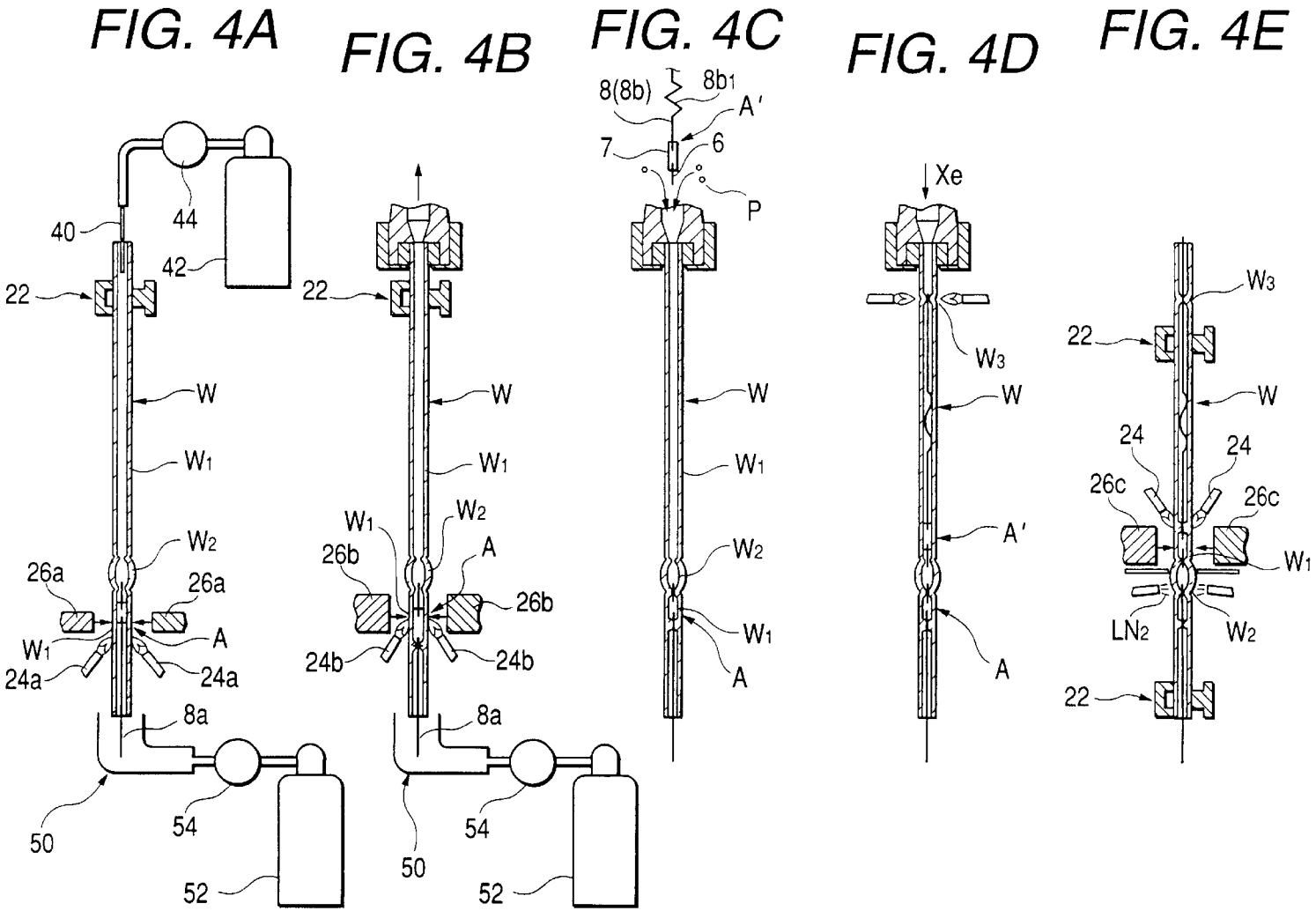
FIGS. 4A to 4E are views illustrating a process for manufacturing an arc tube, particularly.

As shown in FIG. 4A, the primary pinch seal portion 13A is formed by inserting and providing an electrode A having the electrode 6, the molybdenum 7 and the lead wire 8 (8*a*) connected integrally in series from one of the open ends of the glass pipe W for the arc tube in which the swollen chamber portion $w_2$ is formed on the middle part in the longitudinal direction such that the tip of the electrode 6 is protruded into the chamber portion $w_2$ by a predetermined length, inserting an oxidant gas supply nozzle 40 into the upper open end of the glass pipe W to introduce an antioxidant gas (an inert gas or a reducing gas) into the glass pipe W from above the glass pipe W and inserting the lower end of the glass pipe W into the antioxidant gas supply pipe 50 and primarily pinch-sealing a region L (see FIG. 2) including the molybdenum foil 7 of the glass pipe W with the lower end of the glass pipe exposed to the antioxidant gas (the inert gas or the reducing gas). The reference numerals 42 and 52 denote a gas cylinder filled with the antioxidant gas, and the reference numerals 44 and 54 denote a gas pressure regulator.

Figure 2:
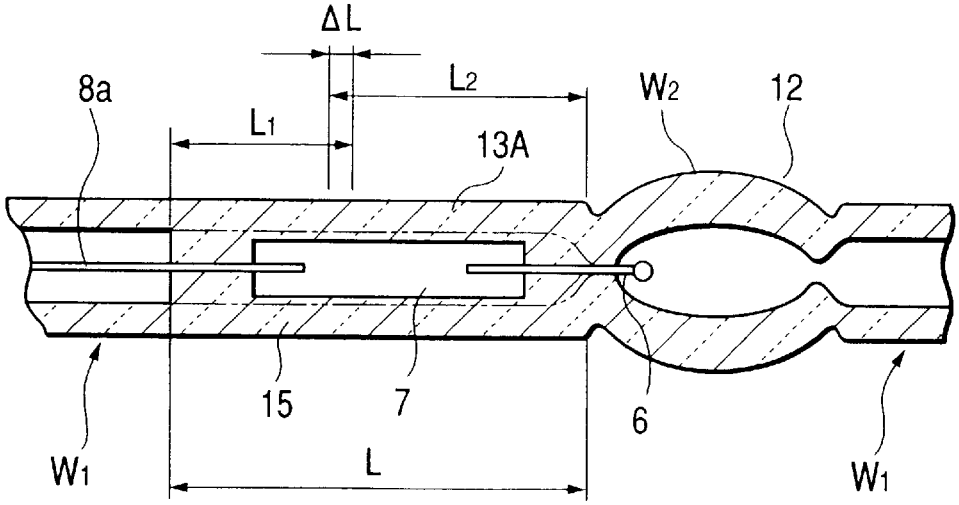
FIG. 2 is an enlarged sectional view showing a primary pinch seal portion.
Figure 3A:
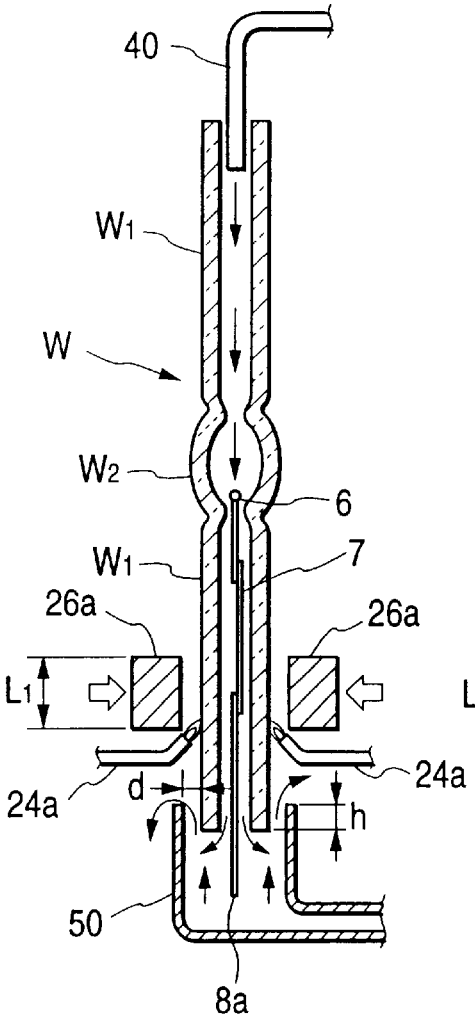
FIGS. 3A and 3B are a sectional view illustrating the state in which the primary pinch seal portion of the arc tube is formed, particularly.
Figure 3B:
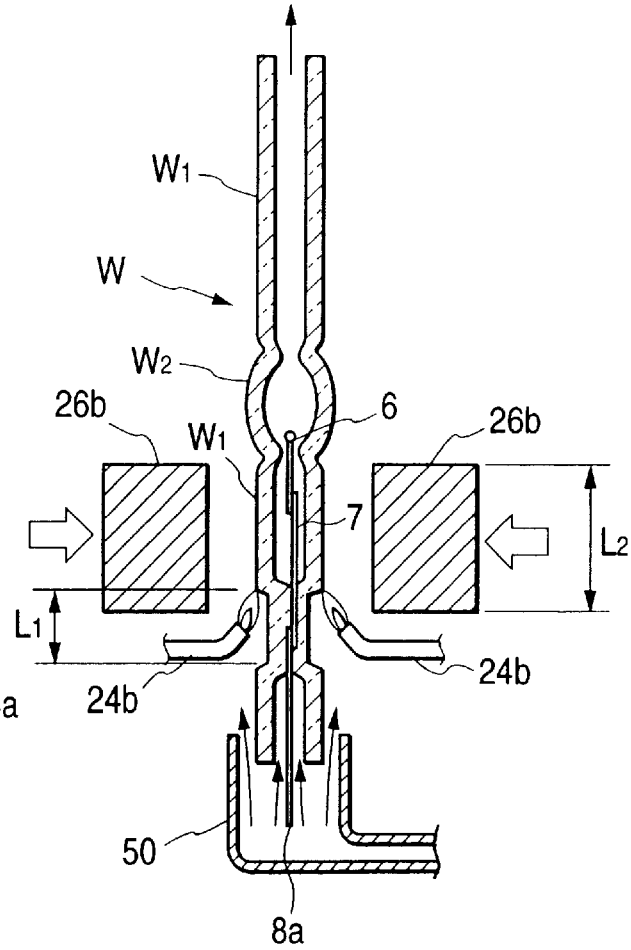

In order to form the primary pinch seal portion 13A, first of all, a region having a predetermined length $L_1$ including the side of the molybdenum foil 7 to which the lead wire 8*a* is to be connected is subjected to provisional pinch seal as shown in FIGS. 2 and 3A. Then, the glass pipe W is held to have a predetermined degree of vacuum and a residual region having a predetermined length $L_2$ in the region to be primarily pinch-sealed is regularly pinch-sealed as shown in FIGS. 2 and 3B. Consequently, the primary pinch seal portion 13A can be formed. The length $L_1$ for the provisional pinch seal and the length $L_2$ for the regular pinch seal overlap each other by a predetermined length ($\Delta L$).

When the provisional pinch seal is carried out using a pincher 26*a* and the residual region to be pinch-sealed is then subjected to the regular pinch seal with a pincher 26*b*, a negative pressure applied by the vacuum in the glass pipe W, as well as the press force of the pincher 26*b*, acts on the heated and softened glass layer 15. Consequently, the glass layer 15 is welded to the surface of the molybdenum foil 7 by pressure and is fixed in close without a clearance. Thus, the molybdenum foil 7 is stuck well to the glass layer 15 and both of them are firmly joined in the pinch-sealed portion having the length $L_2$.

During the provisional pinch seal, the antioxidant gas introduced from the nozzle 40 into the glass pipe W is discharged from the lower open end and overflows from the opening of the pipe 50 together with the antioxidant gas led from the gas supply pipe 50 in the lower portion (see an arrow of FIG. 3A).

For this reason, when the linear extended portion $w_1$ of the glass pipe W is to be provisionally pinch-sealed, the electrode assembly A in the glass pipe W is held in the antioxidant gas atmosphere, the molybdenum lead wire 8*a* is not oxidized in contact with the air and the heat transferred to the lead wire 8*a* is cooled with the antioxidant gas. Consequently, the lead wire 8*a* can be prevented from being heated up to a high temperature. In addition, the molybdenum structure can be prevented from being evaporated and recrystallized.

During the regular pinch seal, furthermore, the antioxidant gas introduced from the nozzle 40 into the glass pipe W is not led to the lower open end because the provisional pinch seal portion is provided. However, the antioxidant gas led from the gas supply pipe 50 covers the whole lower open end of the glass pipe W and overflows from a clearance between the open end of the glass pipe W and the gas supply pipe 50 as shown in an arrow of FIG. 3B.

Consequently, the lead wire 8*a* is held in the antioxidant gas atmosphere for a while in which the primary pinch seal portion 13A is maintained in a high temperature state after the regular pinch seal as well as during the regular pinch seal. Therefore, the lead wire 8*a* is not oxidized at the primary pinch-sealing step. Furthermore, the lead wire 8*a* is cooled with the antioxidant gas. Therefore, the molybdenum structure constituting the lead wire 8*a* can be prevented from being evaporated and recrystallized due to the high temperature.

Next, a process for manufacturing an arc tube having the chipless sealed chamber portion 12 shown in FIG. 1 will be described with reference to FIGS. 4A to 4E.

First of all, the glass pipe W having the spherical swollen portion $w_2$ formed in the middle of the linear extended portion $w_1$ is manufactured in advance. As shown in FIG. 4A, the glass pipe W is held vertically and the electrode assembly A is inserted from the lower open end side of the glass pipe W and is then held in a predetermined position. In addition, the antioxidant gas (an inert gas or a reducing gas) supply nozzle 40 is inserted into the upper open end of the glass pipe W. The antioxidant gas serves to hold the inside of the glass pipe W in a pressurized state during the pinch seal and to prevent the electrode assembly A from being oxidized.

Moreover, the lower open end of the glass pipe W is inserted into the gas supply pipe 50. The antioxidant gas (the inert gas or the reducing gas) supplied from the pipe 50 serves to hold the lead wire 8*a* having the high temperature in the antioxidant gas atmosphere, and to prevent the lead wire 8*a* from being oxidized at the primary pinch-sealing step. Furthermore, the antioxidant gas supplied from the pipe 50 also serves to cool the lead wire 8*a* and to prevent the molybdenum structure of the lead wire 8*a* from being evaporated and recrystallized. The reference numeral 22 denotes a glass pipe holding member.

Then, a predetermined position including the molybdenum foil 7 in the linear extended portion $w_1$ is heated by means of the burner 24*a* while the antioxidant gas is supplied from the nozzle 40 and the pipe 50 into the glass pipe W respectively. Thus, the side of the molybdenum foil 7 to which the lead wire 8*a* is to be connected is provisionally pinch-sealed with the pincher 26*a*.

As shown in FIG. 4B, next, the upper open end of the glass pipe W is connected to a vacuum pump (not shown) with the lower open end of the glass pipe W inserted in the pipe 50. Thus, the glass pipe W is maintained in a vacuum state. Then, a predetermined position in the linear extended portion $w_1$ is heated with the burner 24*b*, and a portion including the molybdenum foil 7 which has not been pinch-sealed is regularly pinch-sealed with the pincher 26*b*.

In the primary pinch seal portion 13A, consequently, the glass layer 15 is closely bonded to the electrode 6, the molybdenum foil 7 and the lead wire 8 constituting the electrode assembly A. In the regularly pinch-sealed portion, particularly, the glass layer 15 is closely bonded to the electrode 6 and the molybdenum foil 7 without a clearance and is fully stuck thereto. Therefore, the glass layer 15 and the molybdenum foil 7 (the electrode 6) are joined firmly.

During the regular pinch seal, the heat of the pinch seal portion 13A to be set in a high temperature state is transferred to the lead wire 8*a* so that the lead wire 8*a* is set to have a high temperature. However, since the lead wire 8*a* is held in the atmosphere of the antioxidant gas supplied from the gas supply pipe 50, it is not oxidized. Furthermore, the lead wire 8*a* is cooled with the antioxidant gas supplied from the pipe 50. Therefore, the molybdenum structure can be prevented from being evaporated and recrystallized due to the high temperature. Accordingly, the lead wire 8*a* led from the primary pinch seal portion 13A has the original mechanical strength of the lead wire.

As shown in FIG. 4C, next, the luminescent substance P is put from the upper open end side of the glass pipe W into the spherical swollen portion $w_2$ and another assembly A' having the electrode 6, the molybdenum foil 7 and the lead wire 8*b* connected integrally is inserted and held in a predetermined position. The lead wire 8*b* is provided with a W-shaped bent portion $8b_1$ on the middle part in a longitudinal direction. The electrode assembly A' can be held in a predetermined position of the linear extended portion $W_1$ in the longitudinal direction with the bent portion $8b_1$ welded to the inner peripheral surface of the glass pipe W by pressure.

After the glass pipe W is evacuated, an upper predetermined portion of the glass pipe W is sealed while a discharge starting gas (for example, Xe gas) is supplied into the glass pipe W as shown in FIG. 4D. Consequently, the electrode assembly A' is provisionally fastened into the glass pipe W and the discharge starting gas and the luminescent substance P are filled. The reference numeral $W_3$ denotes a sealed portion.

As shown in FIG. 4E, then, a position in the vicinity of the spherical swollen portion $w_2$ in the linear extended portion $w_1$ (a position including the molybdenum foil) is heated with a burner 24 and is subjected to secondary pinch seal with a pincher 26*c* while the spherical swollen portion $w_2$ is cooled with liquid nitrogen ($LN_2$) such that the discharge starting gas and the luminescent substance P are not vaporized. Thus, the spherical swollen portion $w_2$ is sealed to form an arc tube having a chipless sealed chamber portion 12 in which the electrodes 6 are provided opposite to each other and the luminescent substance P is sealed.

Finally, the end of the glass pipe W is cut by a predetermined length. Thus, the arc tube 10 shown in FIG. 1 can be obtained.

At the secondary pinch-sealing step, the glass pipe W can be maintained in the vacuum state by cooling and liquefying the discharge starting gas filled in the glass pipe W without making the glass pipe W vacuum with a vacuum pump as in the regular pinch seal at the primary pinch-sealing step. During the pinch seal, therefore, the electrode assembly A' (the electrode 6, the molybdenum foil 7 and the lead wire 8*b*) can be prevented from becoming fragile due to oxidation. Furthermore, it is possible to obtain a high degree of contact of the glass layer 15 in the secondary pinch seal portion 13B with the electrode assembly A' (the electrode 6, the molybdenum 7 and the lead wire 8).

More specifically, the inside of the glass pipe W through which the electrode assembly A' (the electrode 6, the molybdenum foil 7 and the lead wire 8) is inserted is held in the discharge starting gas atmosphere having no oxygen, and the glass pipe W is pinch-sealed in this state. Therefore, the lead wire 8*b* is not oxidized. Moreover, the pinch seal is carried out while the inside of the glass pipe W is held in an almost vacuum state and the spherical swollen portion $W_2$ is cooled with the liquid nitrogen ($LN_2$). Consequently, the heat of the glass pipe W having a high temperature is transferred to the electrode assembly A' (the lead wire 8*b*) with difficulty. Correspondingly, a period for which the lead wire 8*b* is held to have a high temperature can be shortened during the pinch seal and the molybdenum structure can be prevented from being evaporated and recrystallized. Accordingly, the lead wire 8*b* led from the secondary pinch seal portion 13B also has the original mechanical strength of the lead wire in similarity to the lead wire 8*a* on the primary pinch seal portion 13A side.

In the same manner as the regular pinch seal to be carried out at the primary pinch-sealing step, furthermore, a negative pressure, as well as the press force of the pincher 26*c*, acts on the heated and softened glass layer 15. Therefore, the glass layer 15 comes in close contact with the electrode 6, the molybdenum foil 7 and the lead wire 8 without a clearance and is thus stuck well thereto, and is firmly joined to the electrode 6, the molybdenum foil 7 and the lead wire 8*b*.

In the case in which the linear extended portion $w_1$ of the glass pipe W for the arc tube has a thickness (an external shape) of 4.0 mm, it is desirable that the gas supply pipe 50 should have an inside diameter of 5.0 mm to 8.0 mm (a clearance between the pipe 50 and the glass pipe W is 0.5 mm to 2.0 mm), a depth h at which the lower opening of the glass pipe W is inserted into the pipe 50 should be 0.5 mm to 5.0 mm and the flow rate of the antioxidant gas in the pipe 50 should be set to 0.1 to 0.9 litter/min.

Next, the mechanical strength of a molybdenum lead wire having a diameter of 0.45 mm which is led from the primary pinch seal portion will be inspected for the arc tube according to the present embodiment (hereinafter referred to as the present invention) and an arc tube according to a comparative example (hereinafter referred to as the comparative example).

In the comparative example, an argon gas to be an antioxidant gas is supplied from a nozzle 40 and a pipe 50, and pinch seal is carried out in the argon gas atmosphere during provisional pinch seal. On the other hand, while regular pinch seal is carried out, the argon gas to be the antioxidant gas is supplied from the nozzle 40, but the argon gas is not supplied from the pipe 50 . Thus, a primary pinch seal portion is formed.

In the present invention, the argon gas to be the antioxidant gas is supplied from the nozzle 40 and the pipe 50 during the provisional pinch seal and the regular pinch seal. Thus, the provisional pinch seal and the regular pinch seal are carried out in the argon gas atmosphere. Consequently, the primary pinch seal portion 13A is formed.

For the lead wires 8*a* led from the primary pinch seal portions 13A according to the comparative example and the present invention, a bending test and a tensile test were conducted to compare mechanical strengths with each other.

Figure 5:
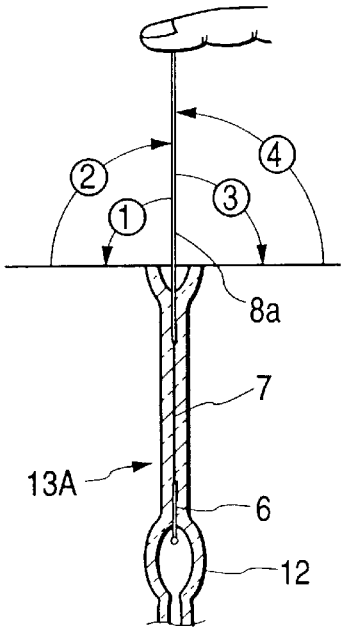
FIG. 5 is a view showing the state of a bending test.

In the bending test, as shown in FIG. 5, the lead wire 8*a* is bent forward at an angle of 90 degrees (first time), is returned to an original position (second time), and is then bent rearward at an angle of 90 degrees (third time) and is returned to the original position (fourth time). This operation was repeated until the lead wire 8*a* is broken. For twenty lead wires 8*a* according to each of the present invention and the comparative example, the number of times at which the operation should be carried out until they are broken was examined.

As a result, the lead wire 8*a* was broken after the operation was carried out at an average of 6.8 times in the comparative example and at an average of 11.8 times in the present invention.

Figure 6:
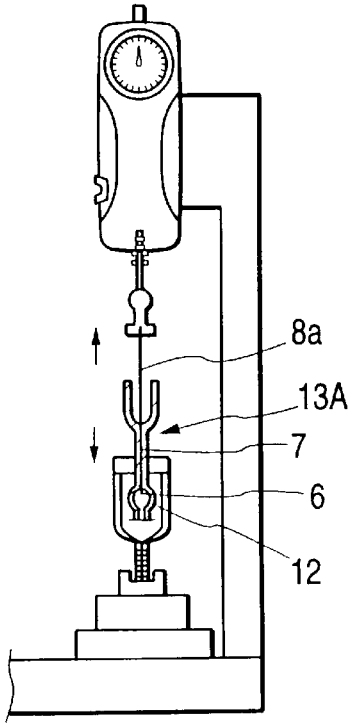
FIG. 6 is a view showing the state of a tensile test.

For the tensile test, a tensile testing machine shown in FIG. 6 was used to obtain a load before the lead wire 8*a* is broken. In the comparative example, the load was at an average of 8.2 kgf (5156 kgf/cm$^2$) in the comparative example and at an average of 18.1 kgf (11381 kgf/cm$^2$) in the present invention. In the present invention, thus, it was confirmed that a tensile strength is about twice as great as that of the comparative example.

While the primary pinch-sealing step is constituted by two pinch-sealing steps, that is, the provisional pinch-sealing step and the regular pinch-sealing step in the above-mentioned embodiment, it is apparent that the present invention can also be applied to the case in which the primary pinch-sealing step is constituted by a one-time pinch-sealing step in the same manner as in the conventional method.

As is apparent from the above description, according to the arc tube for a discharge lamp device in accordance with the first aspect of the present invention, the lead wire on the primary pinch seal portion side has a high mechanical strength and is disconnected with difficulty. Correspondingly, the lifetime of the arc tube can be prolonged.

According to the second aspect of the present invention, the filling substance in the sealed chamber portion is sealed in the primary pinch seal portion reliably so that the lifetime of the arc tube can be further enhanced.

According to the third aspect of the present invention, the lead wire on the secondary pinch seal portion side also has a high mechanical strength in similarity to the lead wire on the primary pinch seal portion side, and furthermore, the filling substance in the sealed chamber portion is sealed reliably in the secondary pinch seal portion so that the lifetime of the arc tube can be enhanced.

According to the method of manufacturing an arc tube for a discharge lamp device in accordance with the fourth aspect of the present invention, the lead wire on the primary pinch seal portion side is not oxidized and a part of a metal structure is neither evaporated nor recrystallized at the pinch-sealing step. Therefore, an original mechanical strength can be held. Consequently, it is possible to obtain an arc tube having a long lifetime.

According to the fifth aspect of the present invention, the lead wire on the secondary pinch seal portion side is not oxidized and a part of a metal structure is neither evaporated nor recrystallized at the pinch-sealing step. Therefore, an original mechanical strength can be held and the filling substance in the sealed chamber portion can be sealed reliably in the secondary pinch seal portion. Consequently, it is possible to obtain an arc tube having a long lifetime.

According to the sixth aspect of the present invention, the lead wire on the primary pinch seal portion side can be prevented reliably from being oxidized at the pinch-sealing step. Consequently, the original mechanical strength can be held so that an arc tube having a long lifetime can be obtained.

According to the seventh aspect of the present invention, the lead wire on the secondary pinch seal portion side also has a high mechanical strength in similarity to the lead wire on the primary pinch seal portion side, and the filling substance in the sealed chamber portion can be sealed reliably in the secondary pinch seal portion. Consequently, it is possible to obtain an arc tube having a long lifetime.

While only certain embodiments of the invention have been specifically described herein, it will be apparent that numerous modifications may be made thereto without departing from the spirit and scope of the invention.

The present invention is based on Japanese Patent Application No. Hei. 11-197000 which is incorporated herein by reference.

What is claimed is:

1. An arc tube for a discharge lamp device comprising a sealed chamber portion provided at a center portion thereof and filed with a luminescent substance, wherein a first electrode assembly and a second electrode assembly both having an electrode, a molybdenum foil, and a molybdenum lead wire connected integrally in series are sealed and fixed such that a region including at least the molybdenum foils are fixed at a primary pinch seal portion and a secondary pinch seal portion, respectively, on both sides of the chamber portion, wherein the electrodes of the first and second electrode assemblies are provided opposite to each other in the chamber portion, and the lead wires of the first and second electrode assemblies are led from the primary and secondary pinch seal portions, respectively, and wherein, in the primary pinch seal portion, an electrode assembly insertion region of a glass pipe for the arc tube is pinch-sealed with the whole first electrode assembly inserted into the glass pipe held in an anti-oxidant gas atmosphere so that the lead wire has a tensile strength of 10000 kgf/cm$^2$ or more.

2. The arc tube for a discharge lamp device according to claim 1, wherein the primary pinch seal portion is formed by a process comprising the steps of:

inserting and providing the first electrode assembly such that a tip of the electrode thereof is protruded from an open end of the glass pipe into the chamber portion;

provisionally pinch-sealing a side of the molybdenum foil to which the lead wire is to be connected;

regularly pinch-sealing a portion of a region to be primarily pinch-sealed which has not been pinch-sealed with holding the glass pipe in a vacuum state.

3. The arc tube for a discharge lamp device according to claim 1, wherein the secondary pinch seal portion is formed by a process comprising the steps of:

inserting and providing the second electrode assembly such that the tip of the electrode is protruded from the open end of the glass pipe into the chamber portion;

removing air in the glass pipe;

filling a discharge starting gas in the pipe with cooling and liquefying the discharge starting gas, thereby holding the glass pipe in a vacuum state after removing air in the glass pipe;

pinch-sealing a region including the molybdenum foil in the glass pipe.

4. The arc tube for a discharge lamp device according to claim 2, wherein the secondary pinch seal portion is formed by a process comprising the steps of:

inserting and providing the second electrode assembly such that the tip of the electrode is protruded from the open end of the glass pipe into the chamber portion;

removing air in the glass pipe;

filling a discharge starting gas in the pipe with cooling and liquefying the discharge starting gas, thereby holding the glass pipe in a vacuum state after removing air in the glass pipe;

pinch-sealing a region including the molybdenum foil in the glass pipe.

5. A method of manufacturing an arc tube for a discharge lamp device, said method comprising:

inserting a first electrode assembly having an electrode, a molybdenum foil and a molybdenum lead wire connected integrally in series from a first open end of a glass pipe for the arc tube having a swollen chamber portion formed in a middle part in a longitudinal direction such that a tip of the electrode of the first electrode assembly is protruded into the chamber portion;

introducing an antioxidant gas from a second open end of the glass pipe into the glass pipe;

inserting the first open end of the glass pipe into a gas chamber to which the antioxidant gas is to be supplied; and pinch-sealing a first region including the molybdenum foil of the first electrode assembly in the glass pipe for a primary pinch seal with holding the first open end of the glass pipe in an antioxidant gas atmosphere.

6. The method of manufacturing an arc tube for a discharge lamp device according to claim 5, wherein the step of pinch-sealing for the primary pinch seal including:

provisionally pinch-sealing a side of the molybdenum foil of the first electrode assembly to which the lead wire is to be connected;

regularly pinch-sealing a portion of the first region to be primarily pinch-sealed which has not been pinch-sealed with holding the glass pipe in a vacuum state.

7. The method of manufacturing an arc tube for a discharge lamp device according to claim 5, wherein the gas chamber includes an inert gas supply port having a greater diameter than bores of the first open end of the glass pipe, and wherein, during pinch-sealing for a primary pinch seal, the first open end of the glass pipe for the arc tube is inserted in the antioxidant gas supply port by a predetermined depth such that the first open end of the glass pipe for the arc tube does not come into contact with air.

8. The method of manufacturing an arc tube for a discharge lamp device according to claim 6, wherein the gas chamber includes an inert gas supply port having a greater diameter than bores of the first open end of the glass pipe, and wherein, during pinch-sealing for a primary pinch seal, the first open end of the glass pipe for the arc tube is inserted in the antioxidant gas supply port by a predetermined depth such that the first open end of the glass pipe for the arc tube does not come into contact with air.

9. The method of manufacturing an arc tube for a discharge lamp device according to claims 5, said method further comprising:

supplying a filling substance from the second open end of the glass pipe to the chamber portion after pinch-sealing the arc tube for the primary pinch seal;

inserting a second electrode assembly having an electrode, a molybdenum foil and a molybdenum lead wire connected integrally in series from the second open end of the glass pipe such that the tip of the electrode is protruded into the chamber portion;

removing air in the glass pipe;

filling a discharge starting gas in the pipe with cooling and liquefying the discharge starting gas, thereby holding the glass pipe in a vacuum state after removing air in the glass pipe; and pinch-sealing a second region including the molybdenum foil of the second electrode assembly in the glass pipe for a secondary pinch seal.

10. The method of manufacturing an arc tube for a discharge lamp device according to claims 6, said method further comprising:

supplying a filling substance from the second open end of the glass pipe to the chamber portion after pinch-sealing the arc tube for the primary pinch seal;

inserting a second electrode assembly having an electrode, a molybdenum foil and a molybdenum lead wire connected integrally in series from the second open end of the glass pipe such that the tip of the electrode is protruded into the chamber portion;

removing air in the glass pipe;

filling a discharge starting gas in the pipe with cooling and liquefying the discharge starting gas, thereby holding the glass pipe in a vacuum state after removing air in the glass pipe; and pinch-sealing a second region including the molybdenum foil of the second electrode assembly in the glass pipe for a secondary pinch seal.

11. The method of manufacturing an arc tube for a discharge lamp device according to claims 7, said method further comprising:

supplying a filling substance from the second open end of the glass pipe to the chamber portion after pinch-sealing the arc tube for the primary pinch seal;

inserting a second electrode assembly having an electrode, a molybdenum foil and a molybdenum lead wire connected integrally in series from the second open end of the glass pipe such that the tip of the electrode is protruded into the chamber portion;

removing air in the glass pipe;

filling a discharge starting gas in the pipe with cooling and liquefying the discharge starting gas, thereby holding the glass pipe in a vacuum state after removing air in the glass pipe; and pinch-sealing a second region including the molybdenum foil of the second electrode assembly in the glass pipe for a secondary pinch seal.

12. The method of manufacturing an arc tube for a discharge lamp device according to claims 8, said method further comprising:

supplying a filling substance from the second open end of the glass pipe to the chamber portion after pinch-sealing the arc tube for the primary pinch seal;

inserting a second electrode assembly having an electrode, a molybdenum foil and a molybdenum lead wire connected integrally in series from the second open end of the glass pipe such that the tip of the electrode is protruded into the chamber portion;

removing air in the glass pipe;

filling a discharge starting gas in the pipe with cooling and liquefying the discharge starting gas, thereby holding the glass pipe in a vacuum state after removing air in the glass pipe; and pinch-sealing a second region including the molybdenum foil of the second electrode assembly in the glass pipe for a secondary pinch seal.

* * * * *